US006241217B1

(12) United States Patent
Tally

(10) Patent No.: US 6,241,217 B1
(45) Date of Patent: Jun. 5, 2001

(54) WIRE-FENCE GAP-CLOSER-GATE FASTENER

(76) Inventor: Jim Tally, Rte. 2, Box. 88A, Paige, TX (US) 78659

( * ) Notice: Subject to any disclaimer, the term of this patent is extended or adjusted under 35 U.S.C. 154(b) by 0 days.

(21) Appl. No.: 09/293,827

(22) Filed: Apr. 16, 1999

(51) Int. Cl.[7] ..... B21F 27/00

(52) U.S. Cl. ..... 256/37; 256/39; 256/47; 256/DIG. 1

(58) Field of Search ..... 256/37, 39, 40, 256/42, 44, 47, 54, DIG. 1, DIG. 3; 403/232.1, 234, 235

(56) References Cited

U.S. PATENT DOCUMENTS

| | | | | |
|---|---|---|---|---|
| 355,135 | * | 12/1886 | Bunch | 256/37 X |
| 553,380 | * | 1/1896 | Zimmerman | 256/37 |
| 626,931 | * | 6/1899 | Rasmussen | 256/37 X |
| 2,772,070 | * | 11/1956 | Stevenson | 256/39 X |
| 3,667,729 | * | 6/1972 | Hinkel | 256/37 |
| 3,961,789 | * | 6/1976 | Tabacheck | 256/37 X |
| 4,493,480 | | 1/1985 | Nichol | 256/10 |
| 4,508,320 | | 4/1985 | Hegarty | 256/47 |
| 5,419,083 | | 5/1995 | Rass | 49/197 |

* cited by examiner

*Primary Examiner*—Lynne H. Browne
*Assistant Examiner*—David E. Bochna
(74) *Attorney, Agent, or Firm*—Derek R. Van Gilder

(57) ABSTRACT

A wire-fence gap-closer-gate fastener has a lever rod (1) that is pivotal vertically on a lever pivot (2) proximate a pivot end of the lever rod. The lever pivot is positioned proximate a lever end of a post-attachment member (3) that is attachable to a top portion of a fixed gate-latch post (4). Fence wiring (6) is extended from a loose gate-latch post (8) to a fixed gate-pivot post (7). For a gate-closed mode, the loose gate-latch post is attachable juxtaposed to the fixed gate-latch post by positioning a top portion of the loose gate-latch post in a top post loop (12) and a handle end (10) of the lever rod is lowered to a lever rest (13) that positions a gate-tightening anchor (9) on the lever rod lower than the lever pivot.

13 Claims, 3 Drawing Sheets

FIG. 7
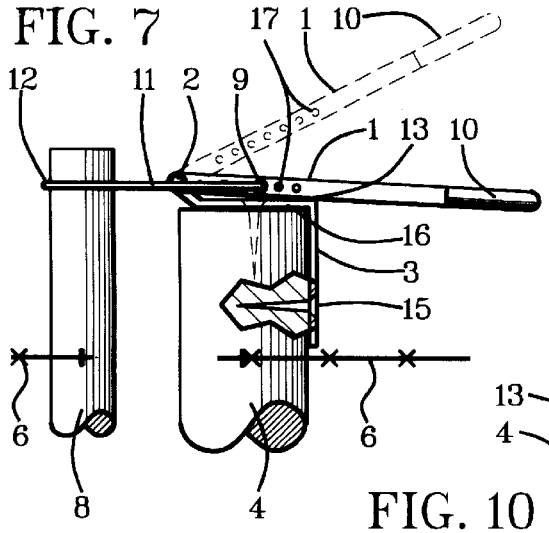
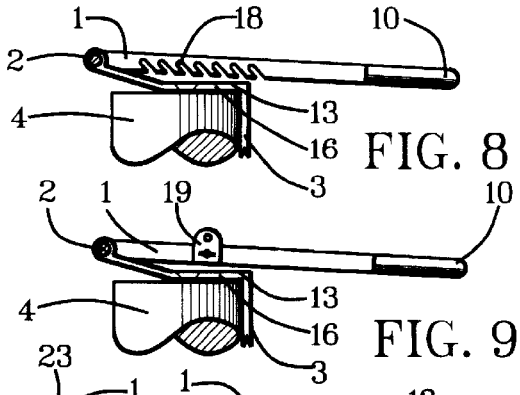
FIG. 8
FIG. 9
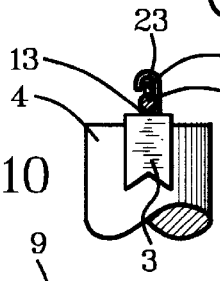
FIG. 10
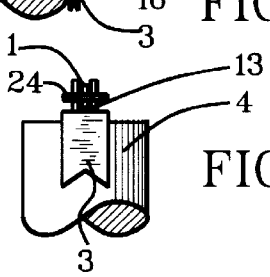
FIG. 11
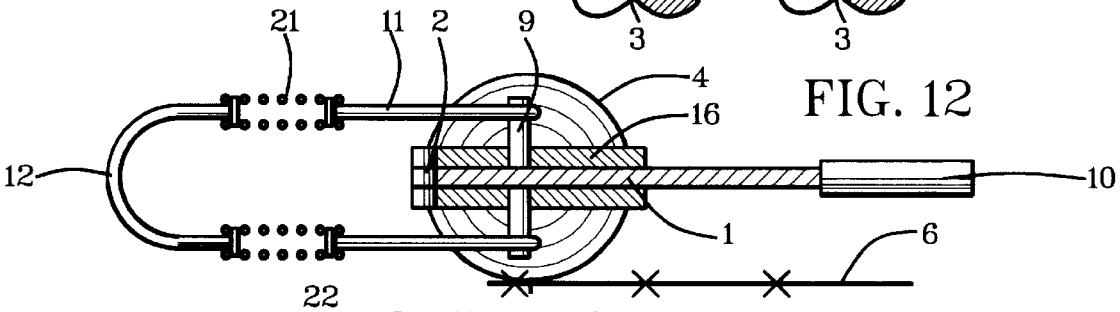
FIG. 12
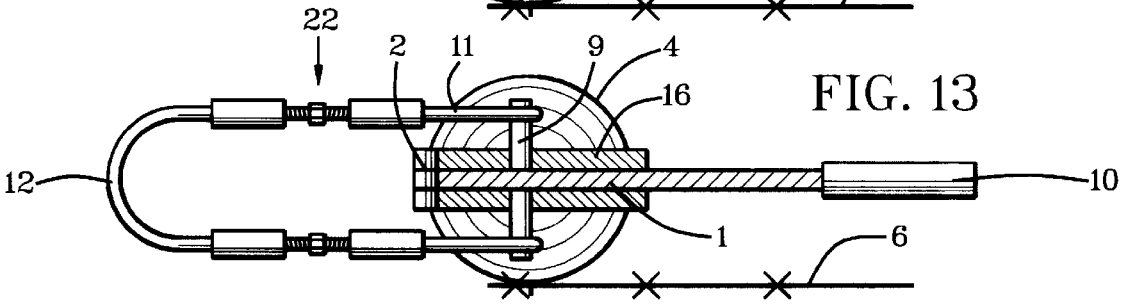
FIG. 13
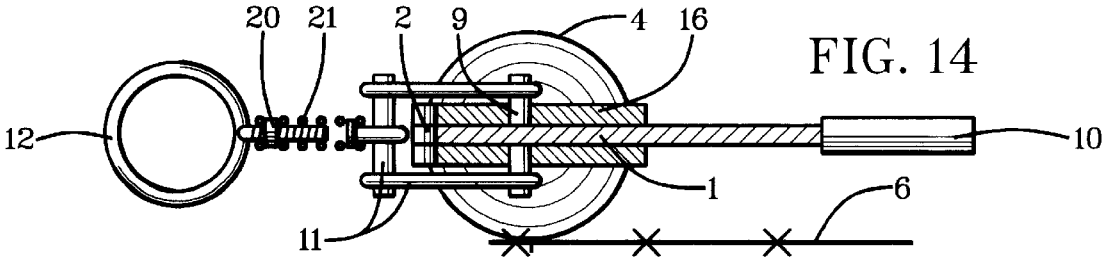
FIG. 14

WIRE-FENCE GAP-CLOSER-GATE FASTENER

BACKGROUND OF THE INVENTION

1. Field of the Invention

This invention relates to fence gates and in particular to connection of a loose gate post to a fixed gate post of a wire-fence gap-closer gate.

2. Relation to Prior Art

Many farm and ranch wire fences have wire-fence gap-closer gates which are not used frequently and which often are not intended to be permanent structure. Accordingly, these wire-fence gap-closer gates are preferably inexpensive instead of elaborate and highly convenient.

Conventionally, wire-fence gap-closer gates have ends of fence wiring from one direction affixed to a loose post that is attachable to a fixed post having fence wiring from another direction. To close a gap-closer gate, a bottom of the loose post is inserted into a bottom loop of wire that is affixed to the fixed post. Then a top of the loose post is positioned in a top loop of wire that is affixed to a top of the fixed post.

Difficulties with these gap-closer gates occur in tightening the top loop on the loose post sufficiently to achieve tightness of fence wiring of the gap-closer gate and sufficiently also to achieve fence tightness of fence wiring attached to fixed posts at opposite sides of the gap-closer gates. Un-looping the top loop to open a tightly closed gap-closer gate is difficult. These are problems that can be overcome inexpensively and conveniently with this invention. The age-old gap-closer gate becomes a gate of relative convenience instead of a time-consuming hassle with unreliable closing.

There are other known wire-fence gates, but none for opening and closing a wire-fence gap-closer gate in a manner taught by this invention.

Examples of different but related gates are described in the following patent documents. U.S. Pat. No. 5,419,083, issued to Rass, described an electric fence with a vertically pivotal arch that was swung up to allow passage under it while maintaining electrical contact across the gate. U.S. Pat. No. 4,508,320, issued to Hegarty, described a total fence system for wire-mesh fences having an angle-iron post that could be used as a gate, terminal or corner post. U.S. Pat. No. 4,493,480, issued to Nichol, described an electrified hanging-wire gate that shocked animals touching closely hanging electrically charged wires to prevent their passage but allowed non-shock passage of vehicles with rubber wheels that insulated against current flow.

SUMMARY OF THE INVENTION

Objects of patentable novelty and utility taught by this invention are to provide a wire-fence gap-closer-gate fastener which:

Permits wire-fence gap-closer gates to be opened and closed quickly and easily;

Assures sufficient tightening of wires of wire-fence gap-closer gates to prevent sagging of gate wires and fence wires at sides of the wire-fence gap-closer gates; and Is sufficiently inexpensive, easy to install and long lasting for low-cost use intended for wire-fence gap-closer gates.

This invention accomplishes these and other objectives with a wire-fence gap-closer-gate fastener having a lever rod that is pivotal vertically on a lever pivot proximate a pivot end of the lever rod. The lever pivot is positioned proximate a lever end of a post-attachment member that is attachable to a top portion of a fixed gate-latch post. Fence wiring is extended in a first direction from the fixed gate-latch post at a latch side of a wire-fence gap-closer gate of a fence. Fence wiring is extended in a second direction from a loose gate-latch post to a fixed gate-pivot post from which the fence wiring of the fence is extended further in the second direction. For a gate-closed mode, the loose gate-latch post is attachable juxtaposed to the fixed gate-latch post. For a gate-open mode, the loose gate-latch post is detachable from the fixed gate-latch post to open the wire-fence gap-closer gate with the loose gate-latch post being hand-held, laid down or otherwise positioned as desired for the gate-open mode.

To attach the loose gate-latch post juxtaposed to the fixed gate-latch post for the gate-closed mode, a first step is to position a bottom portion of the loose gate-latch post in a bottom post loop that is extended from a bottom portion of the fixed gate-latch post in a direction towards the fixed gate-pivot post. A second step is to position a top portion of the loose gate-latch post in a top post loop that has a lever end attached pivotally to a gate-tightening anchor that is pivotal at a desired position intermediate the lever pivot at the pivot end of the lever rod and a handle end of the lever rod. A third step is to lower the handle end of the lever rod to pivot the lever rod downward to a circumferential position in which the gate-tightening anchor is sufficiently below the lever pivot vertically to cause tightness pressure of the fence wiring to maintain the lever rod buttressed against a lever rest. An optional fourth step is fastening the lever rod to the lever rest.

BRIEF DESCRIPTION OF DRAWINGS

This invention is described by appended claims in relation to description of a preferred embodiment with reference to the following drawings which are described briefly as follows:

FIG. 7 is a partially cutaway side view of a top portion of the lever rod with a post-attachment portion on a fence side of the fixed gate-latch post;

FIG. 8 is a side view of a lever rod having a plurality of anchor bays for adjustment of anchoring position of the gate-tightening anchor;

FIG. 9 is a side view of a lever rod having a slidable clamp for adjustment of anchoring position of the gate-tightening anchor;

FIG. 10 is a side view of a top portion of a fixed gate-latch post having a retainer hook on a post-top portion of a post-attachment member;

FIG. 11 is a side view of a top portion of a fixed gate-latch post having a retainer fastener on a post-top portion of a post-attachment member;

FIG. 12 is a top view of a top post loop having spring length and tightening adjustment;

FIG. 13 is a top view of a top post loop having threaded length and tightening adjustment; and FIG. 14 is a top view of a top post loop having a fixed size and a combination of spring and threaded adjustment of distance from the fixed gate-latch post.

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

Figure 1:
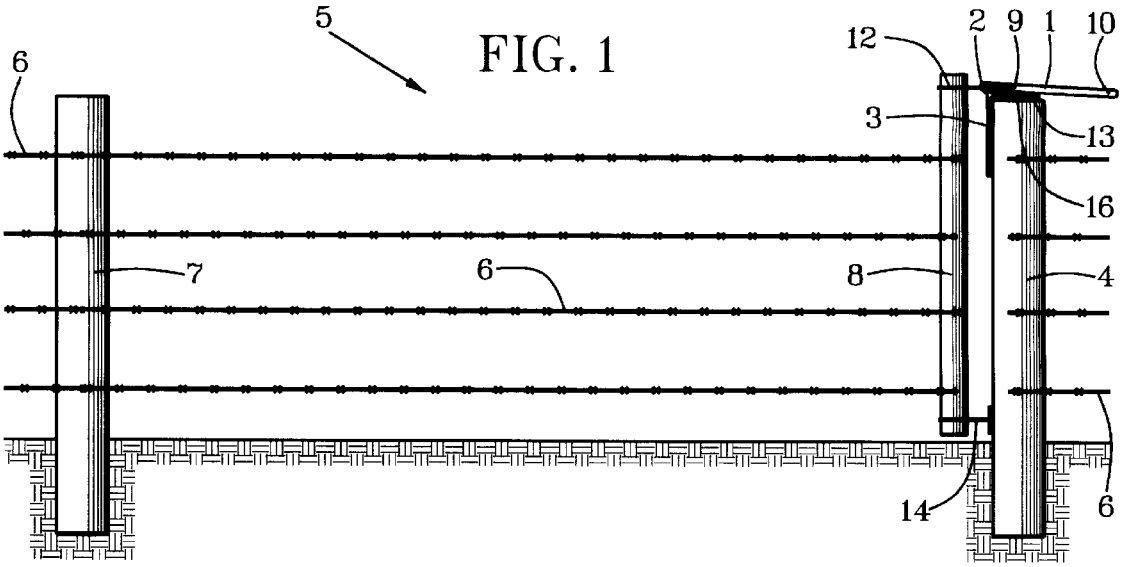
FIG. 1 is a front view of a wire-fence gap-closer gate in closed mode with a lever rod on a lever rest.
Figure 2:
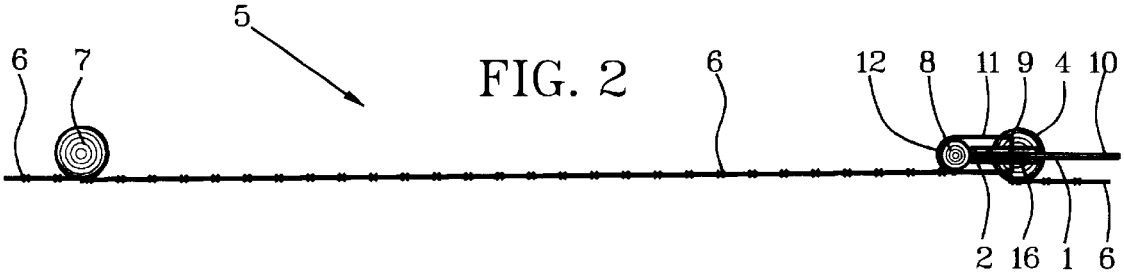
FIG. 2 is a top view of the FIG. 1 illustration.

1. Lever rod
2. Lever pivot
3. Post-attachment member
4. Fixed gate-latch post
5. Wire-fence-gap-closer gate
6. Fence wiring
7. Fixed gate-pivot post
8. Loose gate-latch post
9. Gate-tightening anchor
10. Handle end of lever rod
11. Loop connector
12. Top post loop
13. Lever rest
14. Bottom post loop
15. Fastener orifices
16. Post-top portion
17. Adjustment apertures
18. Adjustment bays
19. Slidable adjustment clamp
20. Pivotal member
21. Resilient member
22. Tightness adjuster
23. Lever hook
24. Lever fastener Reference is made first to FIGS. 1–4 of the drawings. A lever rod 1 has a pivot end that is pivotal vertically on a lever pivot 2 that is positioned proximate a lever-pivot portion of a post-attachment member 3 that is attachable to a top portion of a fixed gate-latch post 4 of a wire-fence gap-closer gate 5 of a fence. Fence wiring 6 is extended intermediate a fixed gate-pivot post 7 proximate a pivot side of the wire-fence gap-closer gate 5 and a loose gate-latch post 8 that is attachable juxtaposed to the fixed gate-latch post 4 proximate a latch side of the wire-fence gap-closer gate 5 in a gate-closed mode as depicted in FIGS. 1–2. A gate-tightening anchor 9 is positioned intermediate the lever pivot 2 end and a handle end 10 of the lever rod 1. A loop connector 11 has a loop-attachment end attached to a top post loop 12 and has an anchor end that is pivotal on the gate-tightening anchor 9.

Figure 3:
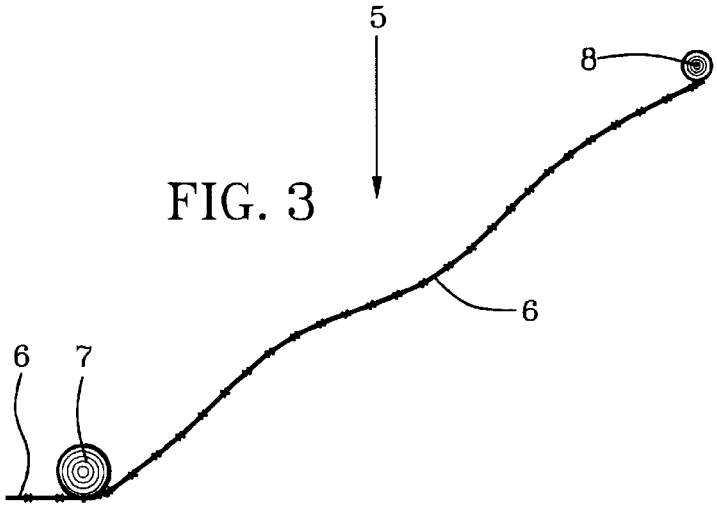
FIG. 3 is a top view of the wire-fence gap-closer gate in an open mode with a loose gate-latch post detached from a fixed gate-latch post.
Figure 4:
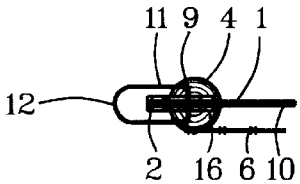
FIG. 4 is a top view of a lever rod with a top post loop from which the loose gate-latch post has been removed.
Figure 5:
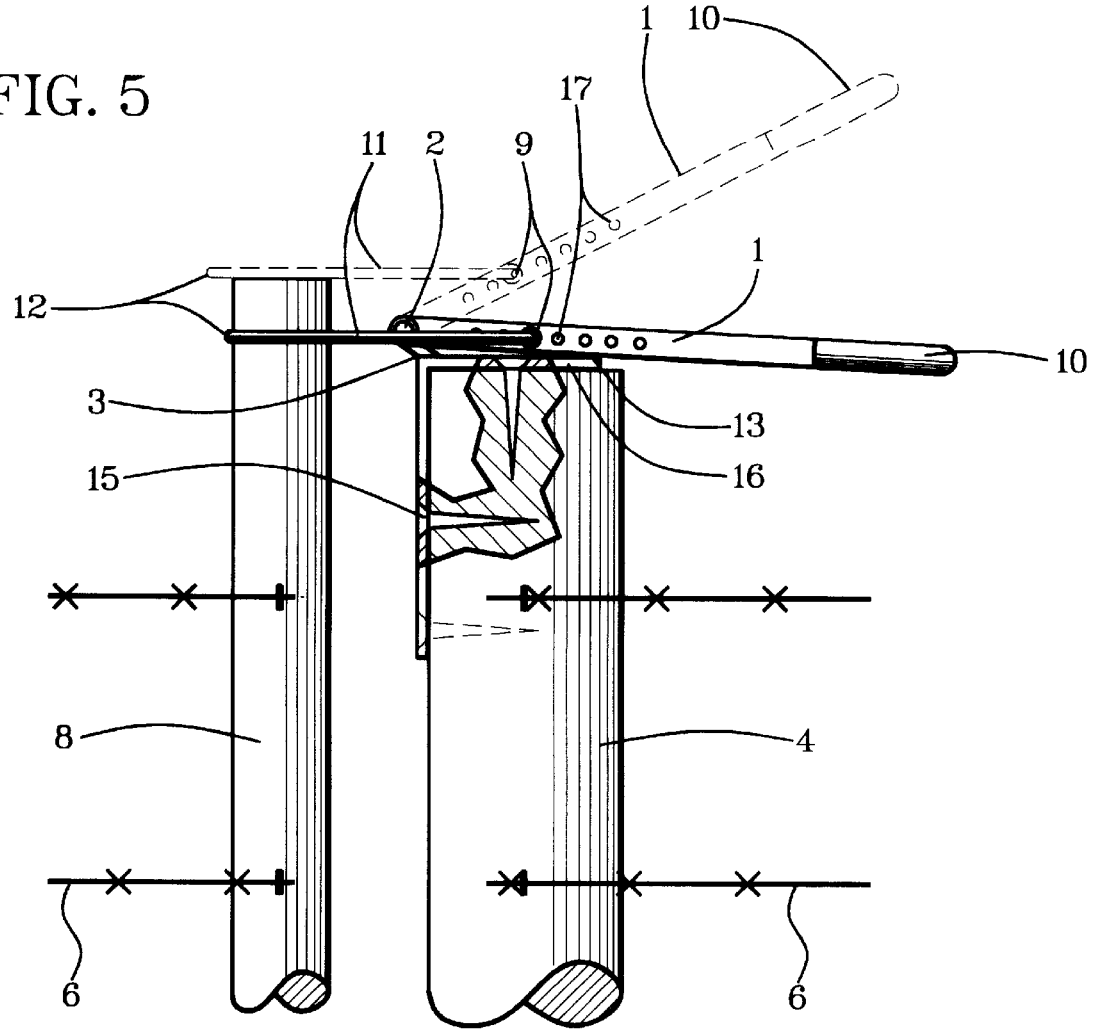
FIG. 5 is a partially cutaway exploded front view of top portions of a loose gate-latch post attached to a fixed gate-latch post with a top post loop attached to an aperture of a gate-tightening anchor on a pivot rod that is in a gate-closed mode resting on a lever rest.
Figure 6:
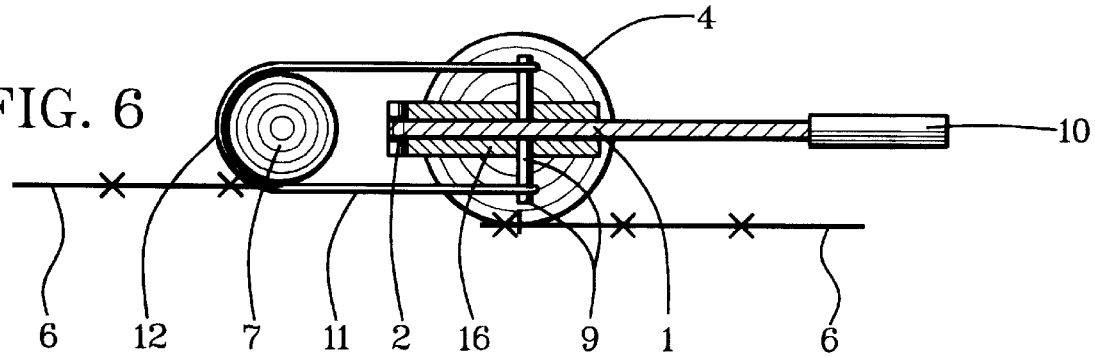
FIG. 6 is a top view of the FIG. 5 illustration.

Referring to FIGS. 1–6, the handle end 10 of the lever rod 1 is lowered to a lever rest 13 for a gate-closed mode after the top post loop 12 is positioned on a top portion of the loose gate-latch post 8 and after a bottom portion of the loose gate-latch post 8 is positioned in a bottom post loop 14 that is attached to a bottom portion of the fixed gate-latch post 4 as shown in FIGS. 1 and 5. For ease of operation, the bottom portion of the loose gate-latch post 8 is positioned in the bottom post loop 14 prior to positioning the top portion of the loose gate-latch post 8 in the top post loop 12.

For a gate-open mode as depicted in FIGS. 3–4, the top post loop 12 is removed from the top portion of the loose gate-latch post 8 after first raising the handle end 10 of the lever rod 1 off of the lever rest 13 to loosen the top post loop 12 on the loose gate-latch post 8. Then the bottom portion of the loose gate-latch post 8 is lifted out of the bottom post loop 14. The loose gate-latch post 8 then can be hand-carried to a position in which the fence wiring 6 of the wire-fence gap-closer gate 5 is loose and not necessarily straight for being laid down or further hand-held in the gate-open mode.

The lever rest 13 is lower vertically than the gate-tightening anchor 9 and lower yet than the lever pivot 2 for the gate-closed mode depicted in FIG. 1 and in FIGS. 5 and 7. With the fence wiring 6 tightened appropriately for straightness without sagging, a contractional tightness is transmitted to the lever rod 1 at the gate-tightening anchor 9. This contractional tightness forces the lever rod 1 down onto the lever rest 13 to maintain tightness of the fence wiring 6 and to maintain the wire-fence gap-closer gate 5 in the gate-closed mode.

The post-attachment member 3 can have one or more fastener orifices 15 on a gate side of the fixed gate-latch post 4 as shown in FIG. 5, or on a fence side of the fixed gate-latch post 4 as shown in FIGS. 7–9. A post-top portion 16 of the post-attachment member 3 is positioned on a top or top portion of the fixed gate-latch post 4 to anchor the post-attachment member 3 and optionally to provide a base for the lever rest 13.

Referring to FIGS. 5–9, tightness of the fence wiring 6 can be assured by adjusting distance of the gate-tightening anchor 9 from either the lever pivot 2 or from the top post loop 12 with a selection of distance adjusters for adjusting either distance. For adjusting distance of the gate-tightening anchor 9 from the lever pivot 2, a series of either adjustment apertures 17 or adjustment bays 18 are positioned in line to receive the gate-tightening anchor 9 selectively intermediate the lever pivot 2 and the handle end 10 of the lever rod 1. Optional also for adjusting distance of the gate-tightening anchor 9 from the lever pivot 2, the lever rod 1 has a slidable adjustment clamp 19 that is clamped to the lever rod 1 at select positions intermediate the lever pivot 2 and the handle end 10 of the lever rod 1.

Referring to FIGS. 12–14, assuring tightness of the fence wiring 6 by adjusting distance from the gate-tightening anchor 9 to the top post loop 12 can be provided by a pivotal member 20 on the loop connector 11 and/or at lease one resilient member 21 on the loop connector 11 to provide contraction pressure intermediate the top post loop 12 and the gate-tightening anchor 9. Optionally or in combination with the resilient member 21, the loop connector 11 can have at least one tightness adjuster 22 with adjustment of distance intermediate the top post loop 12 and the gate-tightening anchor 9. The resilient member 21 can be one or more contraction springs as depicted in FIGS. 12 and 14. The tightness adjuster 22 can be one or more opposed-threading bolts as depicted in FIG. 13 or a single one-way bolt as depicted for the pivotal member 20 in FIG. 14.

Referring to FIGS. 10–11, the lever rod 1 can be maintained in the gate-closed mode by such means as a lever hook 23 as depicted in FIG. 10 or a lever fastener 24 as depicted in FIG. 11. The lever fastener 24 can be a rod-like member such as a bolt or a padlock shackle.

The top post loop 12 can be resilient to assist in maintaining tightness of the fence wiring 6.

This wire-fence gap-closer-gate fastener is used by first assuring that the lever rod 1 is pivoted upwardly to a position that is sufficiently higher than the lever pivot 2 to allow positioning of a top portion of the loose gate-latch post 8 in the top post loop 12. The top portion of the loose gate-latch post 8 is then positioned in the top post loop 12. For a gate-closed mode, the handle end 10 of the lever rod 1 is pivoted vertically downward to position the gate-tightening anchor 9 vertically lower than the lever pivot 2 with the handle end 10 of the lever rod 1 resting on the lever rest 13.

Assuring tightness of the fence wiring 6 is aided by adjusting positioning of the gate-tightening anchor 9 intermediate the lever pivot 2 and the handle end 10 of the lever rod 1.

Prior to positioning the bottom portion of the loose gate-latch post 8 in the bottom post loop 14, adjusting distance of the bottom post loop 14 from the fixed gate-latch post 4 towards the fixed gate-pivot post 7 assures tightness of bottom fence wiring 6 of the wire-fence gap-closer gate 5.

Preferably, a bottom portion of the loose gate-latch post 8 is positioned in the bottom post loop 14 prior to positioning the top portion of the loose gate-latch post 8 in the top post loop 12.

Adjusting distance of the top post loop 12 from the gate-tightening anchor 9 with the tightness adjuster 22 prior to positioning the top portion of the loose gate-latch post 8 in the top post loop 12 can be accomplished in combination with resilience of the resilient member 21 for most reliable use of this invention.

A new and useful wire-fence gap-closer-gate fastener having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A wire-fence gap-closer-gate fastener comprising:

a lever rod having a pivot end that is pivotal vertically on a lever pivot that is positioned on a gate side of a post-top portion of a post-attachment member that is attached to a top portion of a fixed gate-latch post of a wire-fence gap-closer gate of a fence;

a gate-tightening anchor intermediate the lever pivot and a handle end of the lever rod;

a loop connector having a loop-attachment end and having an anchor end that is pivotal on the gate-tightening anchor;

a top post loop attached to the loop connector;

the top post loop being sized and shaped to be positioned on a loose gate-latch post of the wire-fence gap-closer gate;

a lever rest positioned vertically lower than the lever pivot on a fence side of the top portion of the fixed gate-latch post; and the post-attachment member has a post-top portion that is extended horizontally proximate a top of the fixed gate-latch post.

2. A wire-fence gap-closer-gate fastener as described in claim 1 wherein:

the lever rod has a series of adjustment apertures positioned in line to receive the gate-tightening anchor selectively intermediate the lever pivot and the handle end of the lever rod; and the gate-tightening anchor is an axle member on the anchor end of the loop connector.

3. A wire-fence gap-closer-gate fastener as described in claim 1 wherein:

the lever rod has a series of adjustment bays positioned in line to receive the gate-tightening anchor selectively intermediate the lever pivot and the handle end of the lever rod; and the gate-tightening anchor is an axle member on the anchor end of the loop connector.

4. A wire-fence gap-closer-gate fastener as described in claim 1 wherein:

the lever rod has a slidable adjustment clamp that is clamped to the lever rod at select positions intermediate the lever pivot and the handle end of the lever rod; and the gate-tightening anchor is a pivotal member on the anchor end of the loop connector.

5. A wire-fence gap-closer-gate fastener as described in claim 1 and further comprising:

a bottom post loop attached to a bottom portion of the fixed gate-latch post and extended a select distance from the gate side of the fixed gate-latch post to receive a bottom portion of the loose gate-latch post.

6. A wire-fence gap-closer-gate fastener as described in claim 1 wherein:

the lever rest is a top portion of the fixed gate-latch post.

7. A wire-fence gap-closer-gate fastener as described in claim 1 wherein:

the lever rest is a top portion of the post-attachment member.

8. A wire-fence gap-closer-gate fastener as described in claim 1 wherein:

the lever rest has a lever hook with which the lever rod is retained in the gate-closed mode.

9. A wire-fence gap-closer-gate fastener as described in claim 1 wherein:

the lever rest has a lever fastener with which the lever rod is retained in the gate-closed mode.

10. A wire-fence gap-closer-gate fastener as described in claim 1 wherein:

the top post loop is resilient.

11. A wire-fence gap-closer-gate fastener as described in claim 1 and further comprising:

the loop connector has at least one resilient member with contraction pressure intermediate the top post loop and the gate-tightening anchor.

12. A wire-fence gap-closer-gate fastener as described in claim 1 and further comprising:

the loop connector has at least one tightness adjuster with adjustment of distance intermediate the top post loop and the gate-tightening anchor.

13. A wire-fence gap-closer-gate fastener as described in claim 12 and further comprising:

in combination with the tightness adjuster, the loop connector has at least one resilient member with contraction pressure intermediate the top post loop and the gate-tightening anchor.

* * * * *